US005775005A

United States Patent [19]

McClelland

[11] Patent Number: 5,775,005

[45] Date of Patent: Jul. 7, 1998

[54] FOOTWEAR SOLE WITH CLEATED WINDOW

[75] Inventor: Larry W. McClelland, Rockford, Mich.

[73] Assignee: Wolverine World Wide Inc., Rockford, Mich.

[21] Appl. No.: 493,334

[22] Filed: Jun. 21, 1995

[51] Int. Cl.[6] ..... A43B 13/20; A43B 13/18; A43B 5/00

[52] U.S. Cl. ..... 36/31; 36/28; 36/30 A; 36/67 A; 36/134

[58] Field of Search ..... 36/25 R, 28, 30 A, 36/31, 59 R, 61, 67 R, 67 A, 114, 134

[56] References Cited

U.S. PATENT DOCUMENTS

| | | | |
|---|---|---|---|
| D. 190,162 | 4/1961 | Hubbard . | |
| D. 311,989 | 11/1990 | Parker et al. . | |
| 1,165,847 | 12/1915 | Cashman . | |
| 1,559,532 | 10/1925 | Smith . | |
| 1,981,300 | 11/1934 | Berg . | |
| 2,090,881 | 8/1937 | Wilson . | |
| 2,710,461 | 6/1955 | Hack . | |
| 2,833,057 | 5/1958 | Hack . | |
| 2,930,149 | 3/1960 | Hack et al. . | |
| 2,937,462 | 5/1960 | Hack et al. . | |
| 2,941,316 | 6/1960 | Hack . | |
| 2,941,317 | 6/1960 | Hack . | |
| 2,963,800 | 12/1960 | Hack . | |
| 2,994,326 | 8/1961 | Hack . | |
| 3,005,272 | 10/1961 | Shelare et al. . | |
| 3,006,085 | 10/1961 | Bingham . | |
| 3,012,342 | 12/1961 | Ramirez . | |
| 3,079,707 | 3/1963 | Hack et al. . | |
| 3,079,708 | 3/1963 | Hack et al. . | |
| 3,299,544 | 1/1967 | Hack . | |
| 3,426,455 | 2/1969 | Drago . | |
| 3,444,632 | 5/1969 | Hack et al. . | |
| 3,466,763 | 9/1969 | Levin | 36/67 A |
| 3,507,059 | 4/1970 | Vietas . | |
| 3,717,943 | 2/1973 | Orndorff . | |
| 4,085,527 | 4/1978 | Riggs | 36/114 |
| 4,120,102 | 10/1978 | Kenigson . | |
| 4,319,412 | 3/1982 | Muller et al. . | |
| 4,347,673 | 9/1982 | Svetlik | 36/30 R |
| 4,434,565 | 3/1984 | Haley | 36/59 R |
| 4,472,890 | 9/1984 | Gilbert | 36/28 |
| 4,712,314 | 12/1987 | Sigoloff . | |
| 4,747,220 | 5/1988 | Autry et al. | 36/59 R |
| 4,817,304 | 4/1989 | Parker et al. . | |
| 4,845,863 | 7/1989 | Yung-Mao . | |
| 4,910,882 | 3/1990 | Goller . | |
| 4,974,345 | 12/1990 | Yung-Mao . | |
| 5,005,300 | 4/1991 | Diaz et al. | 36/114 |
| 5,084,988 | 2/1992 | Berger | 36/31 |
| 5,199,191 | 4/1993 | Moumdjian . | |
| 5,201,125 | 4/1993 | Shorten | 36/29 |
| 5,255,451 | 10/1993 | Tong et al. . | |
| 5,363,570 | 11/1994 | Allen et al. | 36/114 |
| 5,367,791 | 11/1994 | Gross et al. | 36/25 R |
| 5,402,588 | 4/1995 | Graham et al. | 36/28 |
| 5,493,791 | 2/1996 | Kramer | 36/28 |

FOREIGN PATENT DOCUMENTS

| | | | |
|---|---|---|---|
| 388661 | 9/1990 | European Pat. Off. . | |
| 399332 | 11/1990 | European Pat. Off. . | |
| 1302331 | 7/1962 | France . | |
| 1056967 | 5/1959 | Germany | 36/25 R |
| 3924360 | 1/1991 | Germany | 36/134 |
| 499735 | 11/1954 | Italy | 36/30 R |
| 137555 | 10/1952 | Sweden . | |
| 1444091 | 7/1976 | United Kingdom . | |

OTHER PUBLICATIONS

WO 81/02969 Oct. 1981 PCT Gustavsen et al 36/29.

Dick Sullivan, "Rugged Clear shoe line sell-through going strong", *Footwear News*, vol. 51, No. 6, Feb. 6, 1995, p. 44.

Photograph of AVIA shoe.

Photograph of Reebok shoe.

Photograph of Cons. shoe.

*Primary Examiner*—M. D. Patterson

*Attorney, Agent, or Firm*—Warner Norcross & Judd

[57] ABSTRACT

A footwear outsole assembly including an outsole body, a pair of cleated windows, and a pair of cushioning inserts on top of the windows. The cleated windows form a portion of the outsole wear surface. Each insert is visible through the corresponding cleated window. The cleated windows extend below the outsole body so that impact forces are absorbed by the windows and inserts.

7 Claims, 4 Drawing Sheets

FOOTWEAR SOLE WITH CLEATED WINDOW

BACKGROUND OF THE INVENTION

The present invention relates to footwear, and more particularly to footwear having an insert and an aperture within the outsole for viewing the insert.

The footwear industry continually works to develop unique sole constructions that blend durability, comfort, and visual aesthetics. One challenge to this goal is that sufficiently durable outsole materials typically do not have the appropriate resiliency to provide the desired comfort. In an attempt to overcome this problem, a variety of constructions have been developed in which a cushioning insert is sandwiched between an insole and a durable outsole. The outsole forms the wear surface of the shoe and is manufactured from a material having the appropriate flexibility and wear characteristics. The insert is protected from wear by the outsole and is manufactured from a material that is resilient enough to provide the desired cushioning. In combination, the outsole and insert provide a sole that is both durable and comfortable.

Manufacturers of soles having cushioning inserts often provide transparent or translucent windows that allow viewing of the inserts within the sole of the shoe. These windows not only allow viewing of the unique design aspects of the inserts, but they also allow the insert to be inspected for any type of defect or damage. One such construction is disclosed is U.S. Pat. No. 4,845,863 issued Jul. 11, 1989 to Yung-Mao, which shows several embodiments of a sole assembly having an outsole and a cushioning insert. In a first embodiment, a transparent window is located in the sidewall of the sole to allow viewing of the cushioning insert. The window opening weakens the sidewall and can adversely affect the durability and resiliency of the sole. In a second embodiment, a transparent window is located in the outsole of the sole to allow viewing of a small portion of the bottom surface of the insert. The window is recessed into the outsole to prevent scuffing or abrasion which could obscure the view through the window. The recessed window reduces the wear surface of the sole. The size of the window is limited by the amount of wear surface the manufacturer is willing to forego.

SUMMARY OF THE INVENTION

The aforementioned problems are overcome by the present invention wherein a footwear sole assembly includes a cleated transparent or translucent window that forms a portion of the wear surface and allows viewing of a cushioning insert.

The sole assembly includes an outsole body defining an aperture. A transparent or translucent cleated insert is mounted within the aperture to provide a cleated window forming a portion of the outsole wear surface. A cushioning insert is mounted on top of the cleated window, preferably within a pocket in the upper portion of the outsole body. The inserts are visible through the window so that the customer/wearer can better appreciate the shoe construction and its function.

The present invention provides a durable and comfortable sole having a cleated window that allows viewing of the cushioning insert and does not reduce the wear surface of the sole.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
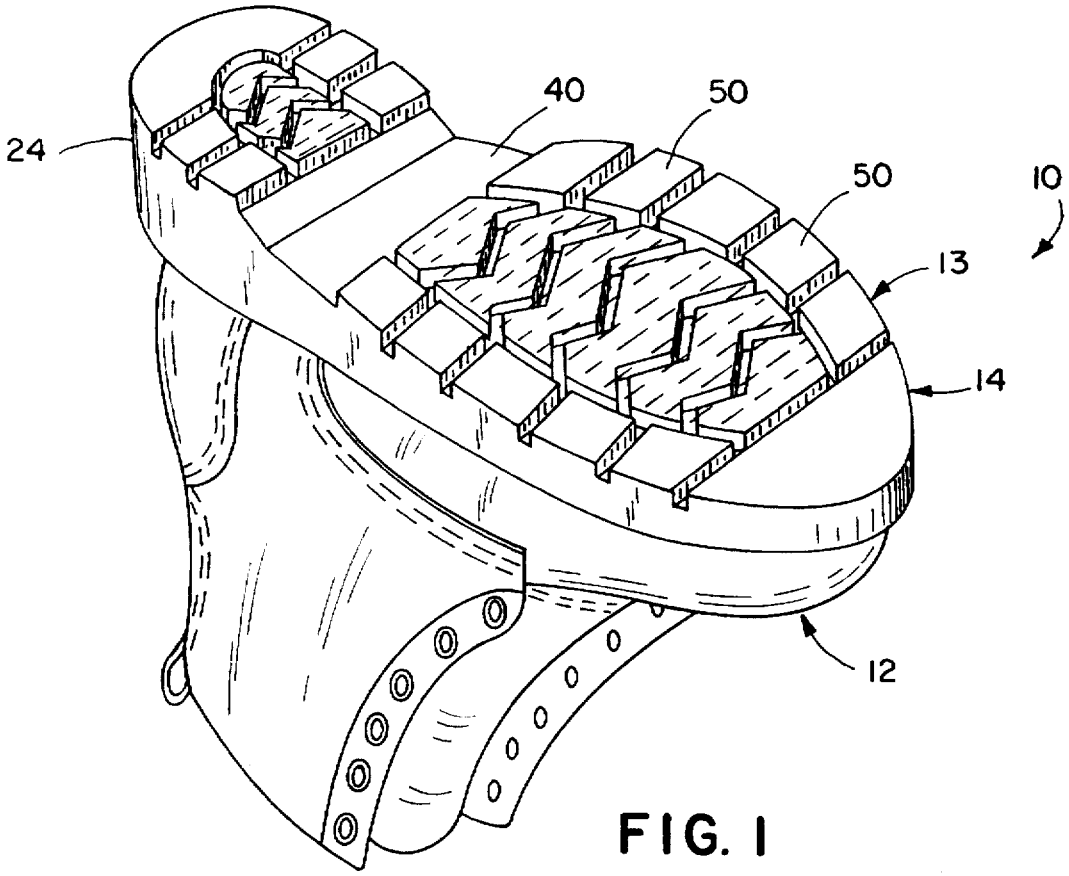
FIG. 1 is a perspective view of a boot having the present outsole assembly.
Figure 2:
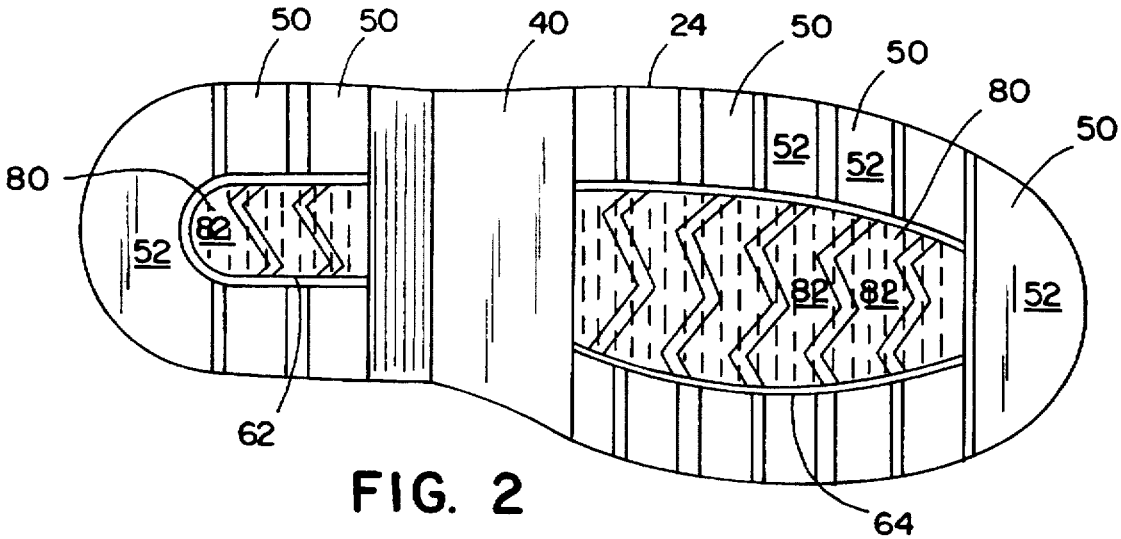
FIG. 2 is a bottom plan view of the outsole assembly.

A boot having an outsole assembly according to a preferred embodiment of the present invention is illustrated in FIG. 1, and generally designated 10. For purposes of this disclosure, the outsole assembly 14 will be described in connection with a conventional mid-height boot. The invention is equally well suited for use in connection with other types of footwear including shoes, sandals, and other soled footwear. Accordingly, the terms "boot" and "shoe" are used interchangeably in this disclosure to refer to soled footwear in general.

The boot 10 shown in FIGS. 1–5 generally includes an upper 12 and a sole assembly 13, which in turn includes the outsole assembly 14 of the present invention and additional components. The upper 12 is manufactured from conventional materials (e.g. leather or other sufficiently durable material) according to conventional methods. The style of the upper 12 and the manner of securing it to the sole assembly 13 will vary depending on the design of the boot. However, in the preferred embodiment, the upper 12 is secured to the sole assembly 13 using a conventional welt construction. This construction will be described in greater detail below.

The outsole assembly 14 includes an outsole body 24, a pair of transparent or translucent cleated windows 34 and 36, and a pair of inserts 30 and 32. The body 24 and the windows 34 and 36 collectively form the wear surface of the boot 10. The cushioning insert 30 and 32 are located above the cleated windows 34 and 36, respectively. The cushioning inserts 30 and 32 are manufactured from a resilient material to improve the comfort of the sole assembly 14. To improve the traction of the boot, a plurality of cleats 50 extend downwardly from the bottom surface 40 of the outsole body 24. Preferably, the bottom surface 52 of each cleat 50 is textured to provide a non-slip surface. In the preferred embodiment, the outsole body 24 is manufactured from an opaque natural or synthetic resin that is both durable and oil resistant.

Figure 3:
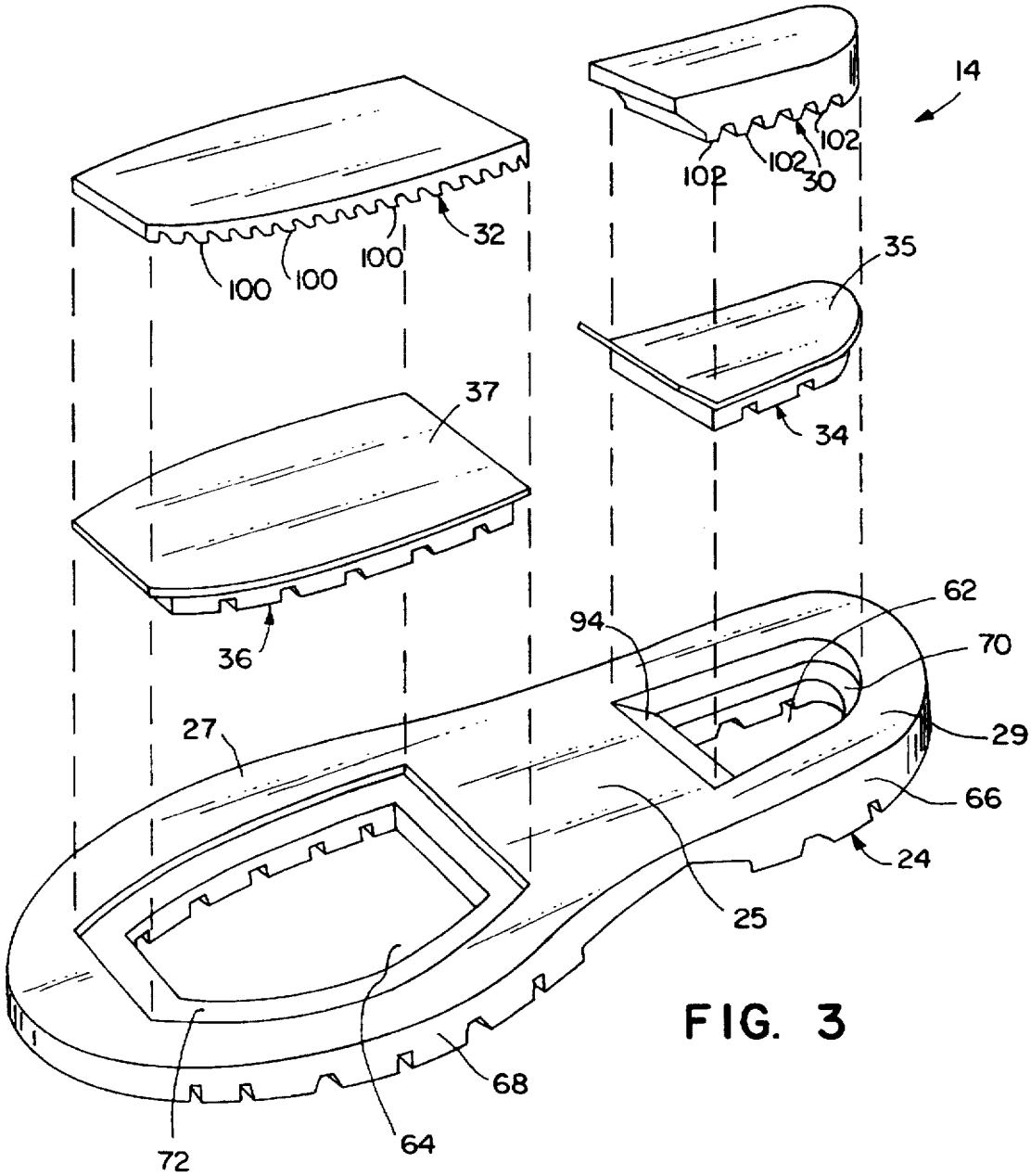
FIG. 3 is an exploded perspective view of the outsole assembly.

As perhaps best illustrated in FIG. 3, the outsole body defines a pair of apertures or openings 62 and 64 in the sole 68 and heel 66 portions of the outsole body 24, respectively. The apertures 62 and 64 are dimensioned to receive the cleated windows 34 and 36 and the cushioning inserts 30 and 32. The outsole body 24 also defines a shoulder 70 and 72 in each aperture 62 and 64, respectively, which provides a seating and sealing surface for the cleated windows 34 and 36.

Figure 4:
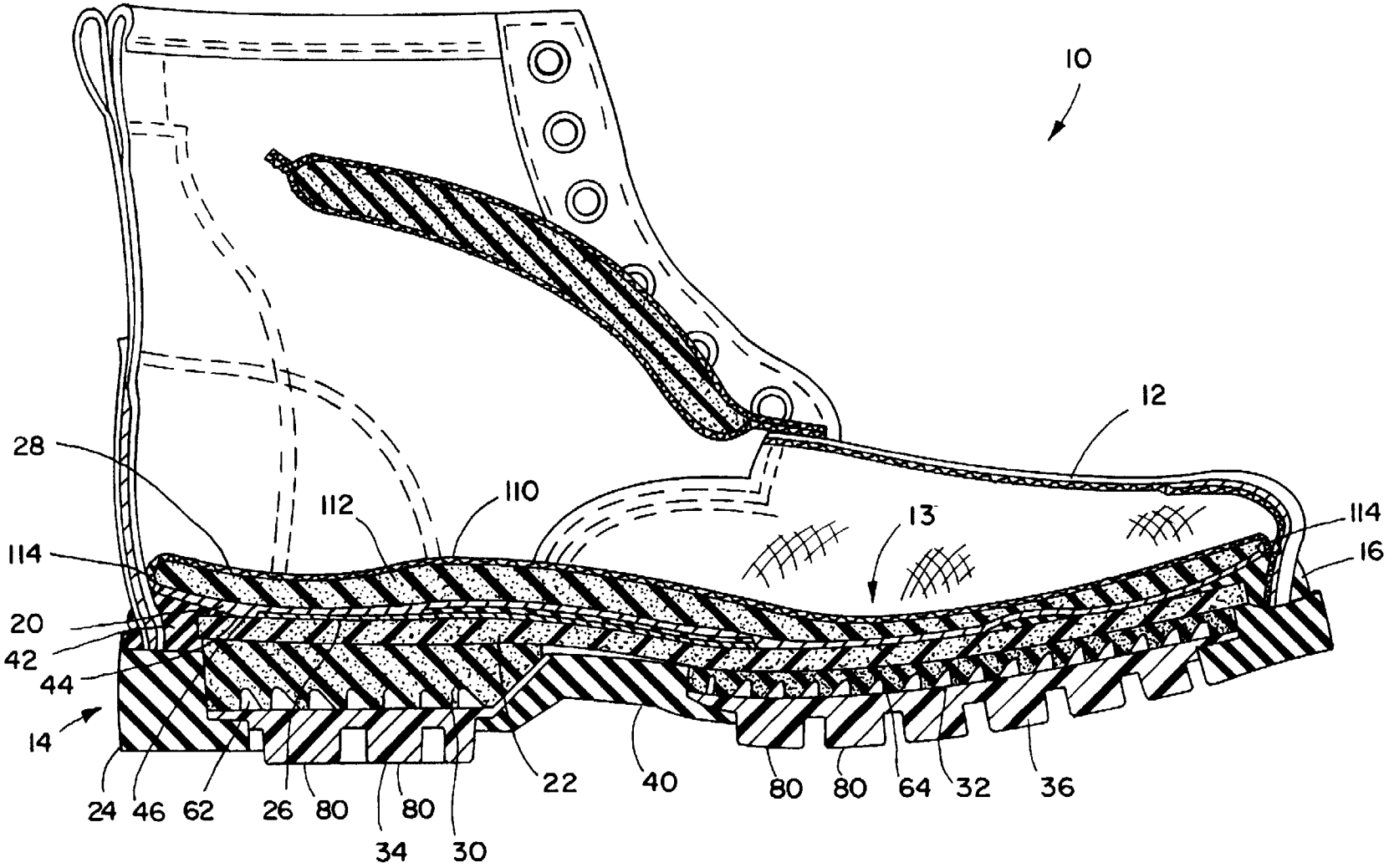
FIG. 4 is a sectional view of the boot taken along line IV—IV in FIG. 1.
Figure 5:
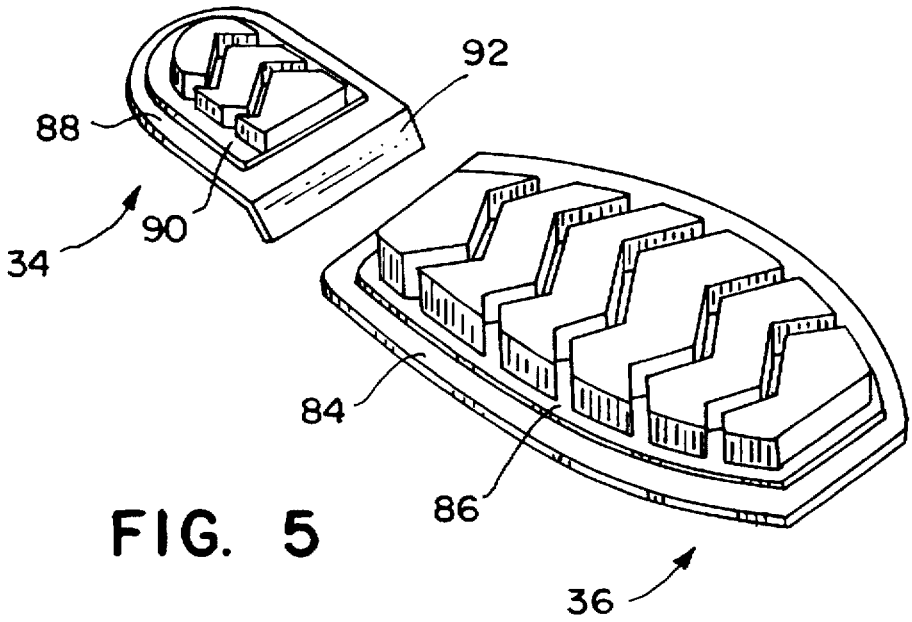
FIG. 5 is a perspective view of the bottom of the cleated windows.

The cleated windows 34 and 36 are secured to and supported by the outsole body 24 (See FIG. 4). The cleated windows 34 and 36 fit within openings 62 and 64, respectively, and include a plurality of cleats 80 extending downwardly through the outsole body 24. These cleats 80 preferably extend downwardly beyond the cleats 50 of the outsole body 24. Consequently, a cushioning action is created as the cleated windows 34 and 36 are forced to flex upwardly into inserts 30 and 32 when weight is applied to the boot 10. The bottom surface 82 of each cleat 80 is textured to provide a non-slip surface (See FIG. 5). With the exception of this surface 82, the cleated windows 34 and 36 remain substantially non-textured to provide a clearer view of the inserts. The cleats 80 of the cleated windows 34 and 36 are preferably shaped and textured to coordinate with and/or to complement the cleats 50 of the outsole body 24.

Cleated window 36 is positioned in the sole portion 68 of the outsole body 24. As perhaps best illustrated in FIGS. 4 and 5, cleated window 36 includes a marginal portion 84 extending around its periphery. This marginal portion 84 is cemented to the shoulder 72 of outsole body 24 within aperture 64. Cleated window 36 also includes a cleat base 86 that extends downwardly to substantially fill opening 64. The cleat base 86 registers the cleated window 36 in opening 64, strengthens the cleated window 36, and provides lateral support to the outsole body 24.

Cleated window 34 is positioned in the heel portion 66 of the outsole body 24. Like cleated window 36, cleated window 34 includes a marginal portion 88 for securing the window 34 to the outsole body 24 and a cleat base 90 for registering the window within aperture 62, strengthening the window 34, and for providing lateral support to the outsole body 24. Cleated window 34 also includes an inclined front marginal portion 92 that is cemented to the front wall 94 of openings 62.

The cleated windows 34 and 36 are manufactured from a durable, transparent or translucent material that is resistant to wear and through which the cushioning inserts 30 and 32 can be viewed. As disclosed, the outsole body 24 forms the periphery of the wear surface; and the cleated windows 34 and 36 form the central portions of the wear surface. However, the configuration can vary with the design of the shoe.

The cushioning inserts 30 and 32 can be any one of a variety known in the art and are dimensioned to fit within openings 62 and 64, respectively, where they are visible through the cleated windows 34 and 36. The design of the cushioning inserts will vary depending on the desired resiliency and visual effect. However, in the preferred embodiment, a series of transverse ribs 100 and 102 extend downwardly from the bottom surface of each insert 30 and 32. These ribs 100 taper downwardly to a rounded end that engages the upper surface 35 and 37 of each cleated window. The ribs 100 of insert 32 are inclined rearwardly toward the central arch area 25. The ribs 102 of insert 34 are inclined forwardly also toward the central arch area 25. During a normal walking stride, the sole assembly 14 is subjected to a downwardly and forwardly directed impact force. This impact force is aligned with the axis of inclination of ribs 102, but transverse to the axis of inclination of ribs 100. Accordingly, the impact force tends to bend ribs 100 transverse to their angle of inclination and compress ribs 102 along their angle of inclination. Because more force is required to compress the ribs than to bend them, ribs 102 provide greater compression resistance than ribs 100. As a result, the forward portion of the sole assembly has a more resilient feel than the heel portion. The inserts 30 and 32 are preferably manufactured from closed cell polyurethane or other sufficiently resilient materials.

The remaining portions of the sole assembly 13 (i.e. other than the outsole assembly 14) will now be described. Pad 22 covers the inserts 30 and 32 and provides additional cushioning. The pad 22 is preferably dimensioned to extend entirely over both inserts 30 and 32. The pad 22 may be cemented directed to the outsole body 24 at central arch area 25. In the preferred embodiment, the pad 22 is manufactured from ethylene-vinyl acetate (EVA). The pad 22 can be manufactured from other flexible, resilient materials.

A steel shank 26 extends above pad 22 to support the shank area of the boot and the arch of the foot. The shank 26 is generally conventional and is preferably secured in place by cementing it to the bottom surface of the insole 20. In a preferred embodiment, the shank 26 is steel and extends longitudinally above pad 22 from heel portion 29 across central arch area 25.

Insole 20 is preferably manufactured of fiberboard or leatherboard and extends entirely across the upper surface of the sole assembly 14. The insole 20 may be cemented to pad 22 to prevent the pad 22 from gathering. A peripheral rib 42 extends downwardly from the bottom surface 44 of the insole 20. In a preferred embodiment, the rib 42 is manufactured from thermoplastic rubber and secured to the bottom surface 44 of the insole by cement or other adhesives. The rib 42 defines a downwardly opening recess 46 large enough to entrap pad 22. Referring now to FIG. 4, the rib 42 is secured to the upper 12 by stitching that extends through the rib 42, the upper 12, and the welt 16. The bottom surfaces of the welt 16 and the rib 42 are cemented to the upper surface of the outsole body 24.

Sock lining 28 covers the insole 20 to separate the foot from the other components of the sole assembly 13. The sock lining 28 is generally conventional and includes a fabric cover 110 overlying a cushioning material 112, such as foam. The fabric cover 110 preferably includes a peripheral, marginal portion 114 that extends beyond the edges of the cushioning material 112. The marginal portion 114 is secured to the insole 20 by cement or other adhesives.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

I claim:

1. A footwear outsole assembly comprising:

an outsole body including an upper side and a lower side, said lower side including a wear surface engaging the ground during walking, said outsole body defining an aperture extending therethrough;

a cushioning insert within said aperture; and a window secured within said aperture below said insert, said window being non-opaque enabling said insert to be viewed through said window, said window including a wear surface engaging the ground during walking, said window wear surface extending below said outsole body wear surface, whereby said window and said insert are compressed during walking.

2. An outsole assembly as defined in claim 1 wherein both of said outsole body wear surface and said window wear surface are cleated.

3. An outsole assembly as defined in claim 2 wherein said aperture comprises over one-quarter of said outsole body wear surface.

4. An outsole assembly as defined in claim 3 wherein:

said outsole body includes a shoulder extending about the perimeter of said window; and said window is seated and sealed on said shoulder.

5. A footwear outsole assembly comprising:

an outsole body having forward and rearward portions and a peripheral edge portion, said outsole body defining an aperture in each of said forward and rearward portions, each of said apertures including a shoulder, said outsole including a plurality of downwardly extending body cleats;

a pair of cleated windows each including a peripheral marginal portion, each of said cleated windows secured within one of said apertures with said peripheral marginal portion engaging said shoulder, said cleated windows being non-opaque, said cleated windows including a plurality of downwardly extending window cleats, said window cleats extending below said body cleats, said outsole body and said cleated windows together defining a wear surface; and a pair of cushioning inserts each located within one of said apertures above one of said windows, said inserts being at least partially visible through said cleated windows, said cushioning inserts being compressed by said cleated windows during walking.

6. The outsole assembly of claim 5 wherein at least one of said cleated windows substantially fills said associated aperture.

7. The outsole assembly of claim 6 wherein said cleats of said one cleated window are textured to provide a non-slip surface; and wherein said cleat base of said one cleated window is non-textured such that at least one of said inserts is readily visible through said cleat base.

* * * * *